US007126087B2

(12) United States Patent
Kamata et al.

(10) Patent No.: US 7,126,087 B2
(45) Date of Patent: Oct. 24, 2006

(54) METHOD OF EFFECTING HEATING AND COOLING IN REDUCED PRESSURE ATMOSPHERE

(75) Inventors: Shigeto Kamata, Kanagawa (JP); Akihiro Kimura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/912,141

(22) Filed: Aug. 6, 2004

(65) Prior Publication Data

US 2005/0029243 A1 Feb. 10, 2005

(30) Foreign Application Priority Data

Aug. 7, 2003 (JP) ..... 2003-288938

(51) Int. Cl.
*F27D 11/00* (2006.01)

(52) U.S. Cl. ..... 219/399; 219/390; 219/405; 219/411; 392/416; 392/418; 118/724; 118/725; 118/50.1

(58) Field of Classification Search ..... 219/390, 219/405, 411, 399; 392/416, 418; 118/724, 118/725, 50.1
See application file for complete search history.

(56) References Cited

U.S. PATENT DOCUMENTS 6,639,189 B1 * 10/2003 Ramanan et al. ..... 219/444.1
6,949,143 B1 * 9/2005 Kurita et al. ..... 118/719
2002/0022430 A1 2/2002 Kimura et al. ..... 445/62

FOREIGN PATENT DOCUMENTS

JP 06-124955 * 5/1994

* cited by examiner

*Primary Examiner*—Shawntina T. Fuqua
(74) *Attorney, Agent, or Firm*—Fitzpatrick, Cella, Harper & Scinto

(57) ABSTRACT

A method of effecting high temperature vacuum heating and cooling suitable for conducting heat treatment to be performed on components used in a display apparatus. The heating/cooling method includes the steps of: heating a plate-like member placed in a reduced pressure atmosphere in a chamber by heating means opposed to the plate-like member; and cooling the plate-like member by a cooling plate which is opposed to the plate-like member, with the heating means therebetween, the cooling plate having a heat reflecting function. The cooling plate has an emissivity of not less than 0.50 but not more than 0.80 so as to minimize a sum of a requisite time for the heating step and a requisite time for the cooling step.

14 Claims, 1 Drawing Sheet

METHOD OF EFFECTING HEATING AND COOLING IN REDUCED PRESSURE ATMOSPHERE

BACKGROUND OF THE INVENTION

1. Field of the Invention

The present invention relates to a method of effecting high temperature vacuum heating and cooling suitable for conducting heat treatment such as baking to be performed on components used in a display apparatus or the like.

2. Related Background Art

Conventionally, apart from a liquid crystal display and a plasma display, an image display apparatus is available in which an electron beam is applied to a phosphor to display an image. The image display apparatus using an electron beam has a substrate face plate on which a phosphor is formed, a substrate rear plate on which there is formed, as an electron source for emitting an electron beam, a cold cathode device, such as a surface conduction type electron emission element, and an external frame for maintaining a reduced pressure atmosphere between the two substrates. In such an image display apparatus using an electron beam, an accelerated electron beam is applied from a surface conduction type electron emission element in a reduced pressure atmosphere to a phosphor, which is caused to emit light, thereby forming an image. In some of such devices, a thin plate-like spacer is provided between the substrates so that the two substrates may not be distorted when pressure reduction is effected in a space defined by the face plate, the rear plate, and the external frame.

The process for manufacturing such an image display apparatus using an electron beam involves heat treatments, which include the processing of firmly attaching the face plate and the rear plate to each other through the intermediation of the external frame, and a baking processing for removing from the substrate surfaces a chemical adsorption water in which water molecules are firmly bonded together through polarization. If an attempt is made to assemble the face plate and the rear plate under reduced pressure without performing this baking processing, a reduction in pressure is not easily achieved due to degassing attributable to chemical adsorption water, and it takes a rather long time to achieve the target vacuum degree for assembly.

When performing baking processing on a rear plate on which an electron source, wiring, etc. have been formed and on a face plate on which wiring and a phosphor have been formed, it is desirable for the processing time to be short from the viewpoint of mitigating the load of the heat treatment on the devices and wiring formed. Further, this baking processing is to be conducted a plurality of times in the production process, so that it is desirable for the time for each baking processing to be short from the viewpoint of reducing the requisite production time. Regarding the shortening of the requisite processing time of a baking processing to be performed on a component used in a vacuum processing apparatus, Japanese Patent Application Laid-open No. H6-124955 discloses a technique, according to which a reflector for heat reflection is provided around a workpiece (a component used in a vacuum processing apparatus) and heating means, and the temperature of a space surrounded by the reflector is raised to thereby effect a heating processing; when the workpiece is to be cooled, a cooling gas is circulated through a cooling jacket provided between the heating means and the reflector inside the vacuum chamber.

However, in the above prior-art technique, while consideration is given to a well-balanced cooling in a short time through a combination of natural cooling and a cooling gas flow, no measures are taken to effect both heating and cooling efficiently, and there has been a demand for an improvement in this regard. Further, in the above-described display apparatus, which has structures, such as a rear plate, a face plate, and a spacer, it is necessary to perform baking on each structure; however, performing baking on these structures individually results in an increase in processing time, which is undesirable. Further, in performing baking in a vacuum, heat distribution may be generated in the rear plate, face plate, spacer, etc., depending on their configuration, which means there is a danger of distortion or cracking being generated in these components.

SUMMARY OF THE INVENTION

To solve the above problems in the prior art, the inventors of the present invention have considered all the factors involved in efficiently effecting both heating and cooling in a reduced pressure atmosphere. It is an objective of the present invention to provide a novel heating/cooling method capable of achieving a reduction in the total requisite time for heating and cooling. It is another objective of the present invention to provide a novel heating/cooling method for performing heating/cooling on a component with a complicated surface configuration in a vacuum atmosphere.

To attain the above objectives, according to the present invention, there is provided a heating/cooling method including: a heating step of heating a plate-like member arranged in a reduced pressure atmosphere in a chamber by heating means opposed to the plate-like member; and a cooling step of cooling the plate-like member by a cooling plate which is opposed to the plate-like member, with the heating means therebetween, and has a heat reflecting function, the method being characterized in that the cooling plate has a emissivity of not less than 0.50 but not more than 0.80.

Further, according to the present invention, there is provided a heating/cooling method including: a heating step of heating a plate-like member arranged in a reduced pressure atmosphere in a chamber by heating means opposed to the plate-like member; and a cooling step of cooling the plate-like member by a cooling plate which is opposed to the plate-like member, with the heating means therebetween, and has a heat reflecting function, the method being characterized in that the cooling plate has a emissivity that is a value which minimizes a sum of a requisite time for the heating step and a requisite time for the cooling step.

Further, according to the present invention, there is provided a method of manufacturing an image display apparatus having a container formed by using a substrate having two main surfaces opposite to each other, the method including: a heating step of heating the substrate arranged in a reduced pressure atmosphere in a chamber by heating means opposed to the substrate; and a cooling step of cooling the substrate by a cooling plate which is opposed to the substrate, with the heating means therebetween, and has a heat reflecting function, the method being characterized in that the cooling plate has a emissivity of not less than 0.50 but not more than 0.80.

Further, according to the present invention, there is provided a method of manufacturing an image display apparatus having a container formed by using a substrate which has two main surfaces (i.e. front face and rear face) opposite to each other, the substrate having an accessory, whose heat capacity is different from that of the substrate, provided on one of the two main surfaces thereof, the method including: a heating step of heating the substrate arranged in a reduced pressure atmosphere in a chamber by heating means opposed to the substrate; and a cooling step of cooling the substrate by a cooling plate which is opposed to the substrate, with the heating means therebetween, and has a heat reflecting function, the method being characterized in that the heating means is opposed to the other of the two main surfaces of the substrate.

Further, according to the present invention, there is provided a method of manufacturing an image display apparatus having a container formed by using a substrate which has two main surfaces opposite to each other, the two main surfaces differing from each other in in-plane emissivity distribution, the method including: a heating step of the substrate arranged in a reduced pressure atmosphere in a chamber by heating means opposed to the substrate; and a cooling step of cooling the substrate by a cooling plate which is opposed to the substrate, with the heating means therebetween, and has a heat reflecting function, the method being characterized in that the heating means is opposed to one of the two main surfaces of the substrate which has a smaller emissivity distribution.

In a first aspect of the present invention, in heating the plate-like member by a heat generating member (heating means) and cooling it by the cooling plate, the emissivity of the cooling plate is appropriately selected. In other words, the emissivity is selected such that the cooling plate has both a heat reflecting function and a cooling function, whereby the total requisite time for heating and cooling is reduced.

More specifically, by setting the emissivity of the cooling plate at a value within a specific range (a value not less than 0.50 but not more than 0.80), an improvement in efficiency is achieved for both the heating processing and the cooling processing. That is, the "cooling plate" used in the heating/cooling processing of the present invention provides, in the cooling process, the basic effect of absorbing heat ray radiated from the heated plate-like member (the object of heating), and, at the same time, provides, in the heating process, the effect of reflecting the heat ray radiated from the heating means toward the object of heating. Thus, the cooling plate is capable of performing the main function of absorbing heat ray radiated from the plate-like member at the time of cooling process, while, at the time of heating process, the cooling plate can re-radiate (by reflection) the heat ray from the heating means toward the plate-like member, so that it is possible to achieve an improvement in heating efficiency. As a result, the total requisite processing time for the heating process and the subsequent cooling process can be reduced.

In a second aspect of the present invention, when heating/cooling a substrate having on one side a component whose heat capacity is smaller than that of the substrate, or a substrate whose emissivity differs between the front and back sides, the arrangement of the heating means and the cooling plate with respect to the substrate is specified, whereby generation of heat distribution in the substrate is prevented, and uniform and efficient heating/cooling is realized. That is, a substrate having on one side thereof a component (e.g., a spacer) whose emissivity is less than that of the substrate is heated/cooled, with the heating means and the cooling plate being arranged so as to face the other side of the substrate, whereby it is possible to prevent the component with small heat capacity from being more abruptly heated/cooled than the substrate. As a result, cracking of the spacer due to abrupt heating/cooling is prevented, and it is possible to realize uniform and efficient heating/cooling of the substrate and the component (spacer) with small heat capacity. Further, a substrate whose emissivity distribution differs between the surface with wiring and the surface with no wiring as a result of the formation of wiring or the like on one surface, for example, a substrate whose surface with wiring has a larger emissivity than its surface with no wiring, is heated/cooled, with the heat generating member and the cooling member being arranged so as to face the surface with no wiring, whereby it is possible to maintain the heat inflow to the substrate and the heat emission from the substrate uniform. As a result, the temperature distribution generated in the substrate is mitigated, thereby preventing distortion and cracking of the substrate.

DESCRIPTION OF THE PREFERRED EMBODIMENTS

Figure 1:
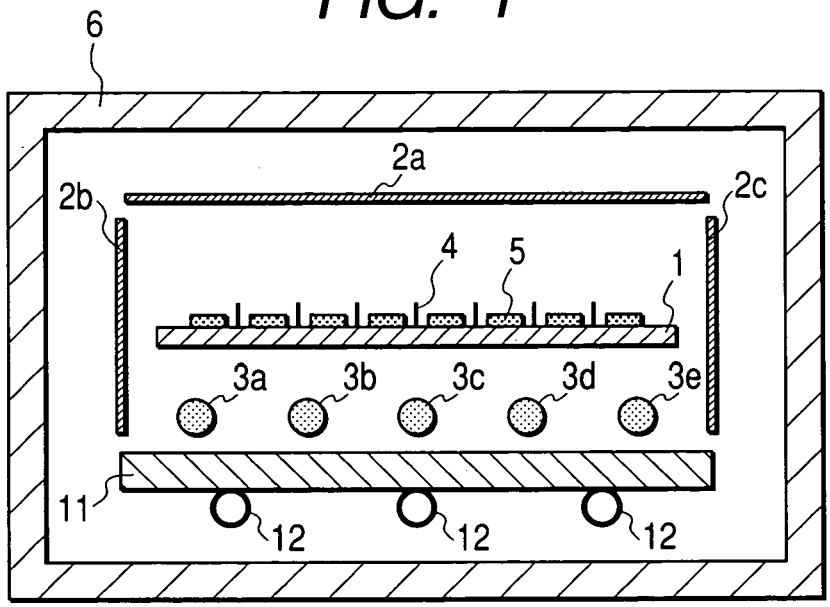
FIG. 1 is a sectional view of an apparatus used in a heating/cooling method of the present invention.

FIG. 1 is a sectional view of an apparatus used in a heating/cooling method of the present invention, showing the features of the present invention most clearly.

Reference numeral 1 indicates a substrate, reference numerals 2*a* through 2*c* are reflection plates constituting heat reflecting members, reference numerals 3*a* through 3*e* indicate heaters serving as heat generating members (heating means), reference numeral 4 indicates spacers, reference numeral 5 indicates on-substrate matter, reference numeral 6 indicates a vacuum chamber, reference numeral 11 indicates a cooling plate constituting a cooling member also having a heat reflecting function, and reference numeral 12 indicates cooling pipes.

In the drawing, the substrate 1 is an electron source substrate constituting a component of the container of an image display apparatus; on the surface of the substrate 1 (on the upper side as seen in the drawing), there is fixed the on-substrate matter 5, which consists of the spacers 4, an electron source, wiring, etc.

On the back surface side (the lower side as seen in the drawing) of the substrate 1, there are arranged heaters 3*a* through 3*e* serving as the heat generating members heating the substrate 1 in a non-contact fashion. Further, below the heaters 3*a* through 3*e*, there is arranged the cooling plate 11, which cools the substrate 1 in a non-contact fashion. The cooling pipes 12 are brazed to the cooling plate 11, and refrigerant is caused to flow through the cooling pipes 12 to recover heat. The emissivity of the substrate 1 side surface (the upper surface) of the cooling plate 11 is set to a value not less than 0.50 but not more than 0.80. The substrate 1 and the heaters 3*a* through 3*e* are covered on all sides (six sides) by one cooling plate and five reflection plates 2*a* through 2*c*. The drawing only shows one cooling plate and three reflection plates. Further, these are placed in the vacuum chamber 6, the interior of which is turned into a reduced pressure atmosphere by a vacuum pump (not shown). The substrate 1 is placed on support pins (not shown), and the support pins and the heaters 3*a* through 3*e* are fixed to the reflection plates 2*a* through 2*c* or the vacuum chamber 6 or the cooling plate 11. To prevent outflow of heat from them, the heaters 3*a* through 3*e* are fixed through the intermediation of a heat insulating material. Further, the reflection plates 2*a* through 2*c* and the cooling plate 11 are fixed to the vacuum chamber 6.

When the substrate 1 is to be heated, the temperature of the heaters 3*a* through 3*e* is raised, and heat energy is imparted to the substrate 1 by radiation. Here, the heaters used are cartridge heaters exhibiting a surface emissivity of 0.80 and adapted to output infrared rays. When the substrate 1 is to be cooled, the heaters 3*a* through 3*e* are turned off, and the heat of the substrate 1 is conducted to the cooling plate 11 by radiation, thereby lowering the temperature of the substrate 1. The heat of the cooling plate 11 is recovered by the refrigerant flowing through the cooling pipes 12.

The emissivity of the surface of the substrate 1 varies depending on the on-substrate matter 5. More specifically, as the on-substrate matter 5, there are provided on one surface of the substrate 1 wiring electrodes formed of metal, electron emission elements consisting of surface conduction type emission elements connected thereto, and spacers arranged between the electron emission elements and consisting of glass members. The spacers 4 consist of thin glass plates whose volume is relatively small as compared with their surface area, which means they exhibit small heat capacity. In contrast, on the back surface (the lower surface) of the substrate 1, there are no accessories, with uniform surface treatment being effected thereon. Thus, this surface exhibits a substantially fixed emissivity. The heaters 3*a* through 3*e* constituting the heat source are provided on the side of this back surface, which, unlike the front surface (i.e., the surface with the wiring, electron emission elements, and spacers arranged thereon) of the substrate 1, exhibits a fixed emissivity, and which has less accessories than the front surface, and heat is imparted to the back surface of the substrate 1 from the heater surface with increased temperature, whereby it is possible to raise the temperature of the substrate 1 uniformly in-plane in a short time. It is possible to restrain generation of temperature distribution due to a difference in emissivity from place to place and a difference in the heat inflow to the substrate 1; further, there is no fear of solely the spacers 4 with small heat capacity undergoing temperature rise. Thus, it is possible to prevent warpage and cracking of the substrate 1 attributable to temperature distribution and cracking of the spacers attributable to a difference in temperature between the substrate 1 and the spacers.

Incidentally, the accessories are not limited to the spaces provided on the electron source substrate, but the accessory may be a rib structure or the like that partitions each pixel region in a PDP. In short, the present invention can also be applied to the substrate for the PDP with the rib structure being provided.

Figure 2:
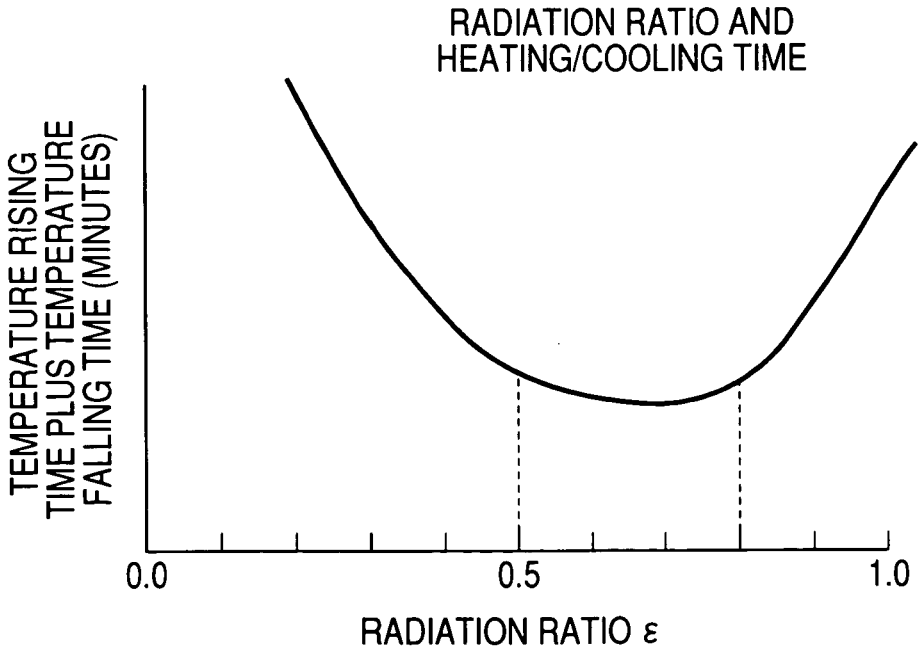
FIG. 2 is a diagram showing the relationship between emissivity and heating/cooling time.

FIG. 2 is a diagram showing the relationship between emissivity and heating/cooling time in this embodiment. The emissivity of the surface of the cooling plate 11 on the substrate 1 side (the upper side) was varied; the sum of the temperature rising time from room temperature to 350° C. and the temperature falling time from 350° C. to 100° C. was substantially minimum when the emissivity was not less than 0.50 but not more than 0.80. Table 1 shows the relationship between emissivity and the total heating/cooling time with respect thereto.

TABLE 1

| emissivity: ϵ | Total Heating/Cooling Time (minutes) |
|---|---|
| 0.82 | 32 |
| 0.81 | 28 |
| 0.80 | 25 |
| 0.70 | 23 |

TABLE 1-continued

| emissivity: ϵ | Total Heating/Cooling Time (minutes) |
|---|---|
| 0.50 | 25 |
| 0.49 | 27 |
| 0.40 | 29 |

As is apparent from FIG. 2 an Table 1, when the emissivity of the cooling plate is not less than 0.50 but not more than 0.80, the change in heating/cooling time is minute, whereas, when the emissivity is between 0.49 and 0.50 and between 0.80 and 0.81, the heating/cooling time changes greatly. As illustrated above, our examination showed that the total heating/cooling time was minimum with the cooling plate having a emissivity of 0.70.

As an example of the base material of the present invention's cooling plate, stainless steel, copper, aluminum or the like can be utilized, and in addition, the emissivity was adjusted by varying the degree to which the blast processing and oxidation processing are effected or by varying the application area ratio of the high emissivity material (black body coating material, ceramic coating material, etc.). Further, here, in obtaining the emissivity, the infrared radiation from the specimen surfaces was directly measured by a Fourier transformation infrared spectrophotometer (FT-IR), and, of the specimen radiation spectrums obtained through ratio calculation with respect to black body radiation at the same temperature as the specimens, the emissivity was obtained as the integration average of wavelengths of 3 to 10 μm.

Here, the meaning of the term "emissivity" will be illustrated. Heat energy radiated toward the surface of an object is partly reflected and partly absorbed. Assuming that the proportion of the heat energy reflected and that of the heat energy absorbed are a reflectance r and anabsorptance$\alpha$, respectively, generally speaking, $r+\alpha=1$ (in a non-transparent object such as metal). In the case of a black body, $\alpha=1$. Assuming that the emissivity of the surface of an object is $\epsilon$, $\epsilon$ is equal to $\alpha$ if the temperature is the same. When the emissivity of the cooling plate 11 is higher than 0.80, the heating thereof takes time; on the other hand, when the emissivity thereof is lower than 0.50, the cooling thereof takes time; in either case, the total requisite time is rather long.

Generally speaking, the emissivity of the cooling plate 11 can assume an arbitrary value within the range of 0 to 1; assuming that the emissivity of the cooling plate can assume a minimum value (0) or a maximum value (1), a problem is obviously involved in such a case. When the emissivity of the cooling plate is 1 (the heat absorptance thereof is 1), the heat reflectance thereof is 0, so that this makes no contribution to the heat treatment of the object, and it is impossible to reduce the heating time. On the other hand, when the emissivity of the cooling plate is 0 (the heat absorptance is 0 and the heat r reflectance is 1), the radiation heat from the heated object cannot be absorbed (due to total reflection), and the cooling function cannot be effected. Thus, it will be understood that a problem is involved whether the emissivity of the cooling plate is large or small. Accordingly, it is necessary to select some specific value between 0 and 1 as the emissivity of the cooling plate. In view of this, in the present invention, as the emissivity of the cooling plate (serving also as a reflection plate at the time of heating processing), an optimum emissivity of the cooling plate is found out (through experiment) taking into account the processing efficiency in both the heating and cooling processes, and such optimum emissivity is adopted.

In this way, the emissivity of the cooling plate 11 is set to a value not less than 0.50 but not more than 0.80, and heat is imparted and recovered mainly to and from the back surface of the substrate 1, whereby it is possible to raise or lower the temperature of the substrate 1 uniformly in-plane in a short time. While it suffices for the emissivity of the cooling plate at this time to be in the range of 0.50 to 0.80, the emissivity of the reflection plate is preferably smaller than the emissivity of the cooling plate, whereby, during cooling, it is possible to avoid a situation in which solely the spacers 4, having small heat capacity, undergo a quick change in temperature. Thus, it is possible to prevent warpage and cracking of the substrate 1 due to temperature distribution therein and to prevent cracking of the spacers due to a difference in temperature between the substrate 1 and the spacers, thereby making it possible to effect heating and cooling at high speed. Further, in the case in which, as described above, spacer members whose heat capacity is smaller than that of the substrate are provided on one surface of the substrate, and, when a substrate whose front and back surfaces differ in emissivity distribution due to the formation of wiring electrodes and electron emission elements is heated or cooled, the heating member and the cooling member are arranged so as to face the other surface of the substrate, whereby it is possible to prevent generation of heat distribution in the substrate, realizing a uniform and efficient heating/cooling. More specifically, it is possible to maintain the heat inflow amount to the substrate and the heat emission amount from the substrate uniform. As a result, it is possible to mitigate the temperature distribution generated in the substrate, and to prevent distortion and cracking of the substrate. It should be noted that this effect is obtained not only in the case in which a cooling plate having a emissivity ranging from 0.50 to 0.80 as described above is used, but also in the case in which a cooling plate having a emissivity out of this range is used.

Further, while cartridge heaters are used as the heaters 3*a* through 3*e* in the example described above, it is also possible to use halogen heaters or the like.

Further, while in this embodiment the reflection plates 2*a* through 2*c* are not cooled, it is also possible to cool them by, for example, fixing cooling pipes thereto.

Next, a method of manufacturing an image display apparatus using this substrate 1 will be described.

Positioning is effected to a sufficient degree on the substrate 1 (rear plate) with wiring electrodes, electron emission elements, and spacers formed thereon and having undergone a heating/cooling process as described above, and on the face plate equipped with phosphor, black matrix, and metal back constituting an acceleration electrode, and the two plates are bonded together through the intermediation of a frame member. As the bonding material, a low-melting-point glass frit is used. This bonding is effected in a reduced pressure atmosphere in the vacuum chamber 6. Like the rear plate, the face plate is preferably subjected to a heating/cooling process as described above prior to the bonding to remove chemical adsorption matter therefrom. In this way, a baking processing for removing chemical adsorption matter is performed in the vacuum chamber, and the bonding of the face plate and the rear plate is effected without destroying the atmosphere in the vacuum chamber 6, whereby it is possible to form an image display apparatus while preventing re-adsorption of chemical adsorption matter. It should be noted that what is important here is that, when bonding together the substrate 1 (rear plate) and the face plate having undergone the heating/cooling process of the present invention, the bonding processing can be performed throughout within a vacuum without destroying the vacuum atmosphere, thereby preventing re-adsorption of chemical adsorption matter. Thus, it is not always necessary for the bonding of the rear plate and the face plate to be executed in the vacuum chamber 6, which has undergone a heating/cooling process; for example, it is also possible to perform the bonding process in another vacuum chamber (e.g., a load lock chamber) communicating with the vacuum chamber 6 through a gate. In this case, it is possible to perform the heating/cooling process and the bonding process with different degrees of vacuum, which is desirable. In accordance with the present invention described above, it is possible to prevent a deterioration in the electron emission characteristics of the electron emission elements, making it possible to realize a high-performance display apparatus.

This application claims priority from Japanese Patent Application No. 2003-288938 filed Aug. 7, 2003, which is hereby incorporated by reference herein.

What is claimed is:

1. A heating/cooling method comprising the steps of:

heating a plate-like member placed in a reduced pressure atmosphere in a chamber by heating means opposed to the plate-like member; and cooling the plate-like member by a cooling plate which is opposed to the plate-like member, with the heating means disposed between the plate-like member and the cooling plate, the cooling plate having a heat reflecting function, wherein the cooling plate has an emissivity of not less than 0.50 but not more than 0.80.

2. A heating/cooling method comprising the steps of:

heating a plate-like member placed in a reduced pressure atmosphere in a chamber by heating means opposed to the plate-like member; and cooling the plate-like member by a cooling plate which is opposed to the plate-like member, with the heating means disposed between the plate-like member and the cooling plate, the cooling plate having a heat reflecting function, wherein the cooling plate an emissivity that is a value which minimizes a sum of a requisite time for the heating step and a requisite time for the cooling step.

3. The heating/cooling method according to claim 1, wherein a heat reflecting member is provided around the plate-like member, and wherein the plate-like member is surrounded by the heat reflecting member and the cooling plate.

4. The heating/cooling method according to claim 1, wherein the cooling plate has a cooling pipe through which a refrigerant is caused to flow.

5. The heating/cooling method according to claim 3, wherein the heat reflecting member has a emissivity smaller than that of the cooling plate.

6. A method of manufacturing an image display apparatus having a container formed by using a substrate having two main surfaces opposite to each other, the method comprising the steps of:

heating the substrate placed in a reduced pressure atmosphere in a chamber by heating means opposed to the substrate; and cooling the substrate by a cooling plate which is opposed to the substrate, with the heating means disposed between the substrate and the cooling plate, the cooling plate having a heat reflecting function, wherein the cooling plate has an emissivity of not less than 0.50 but not more than 0.80.

7. The method of manufacturing an image display apparatus according to claim 6, wherein an accessory whose heat capacity differs from that of the substrate is partially mounted on one of the two main surfaces of the substrate, and wherein the heating means is opposed to the other of the two main surfaces of the substrate.

8. The method of manufacturing an image display apparatus according to claim 7, further comprising the step of assembling the container in a reduced pressure atmosphere, by using the substrate that has been heated and cooled, after the heating step and the cooling step.

9. The method of manufacturing an image display apparatus according to claim 6, wherein the two main surfaces of the substrate differ from each other in an in-plane distribution of emissivity, and wherein the heating means is opposed to one of the two main surfaces of the substrate, which has a smaller distribution of emissivity.

10. The method of manufacturing an image display apparatus according to claim 9, further comprising the step of assembling the container in a reduced pressure atmosphere by using the substrate that has been heated and cooled.

11. A method of manufacturing an image display apparatus having a container formed by using a substrate which has two main surfaces opposite to each other, the substrate having an accessory, whose heat capacity is different from that of the substrate, provided on a first surface of the two main surfaces thereof, the method comprising the steps of:

heating the substrate placed in a reduced pressure atmosphere in a chamber by heating means opposed to the substrate; and cooling the substrate by a cooling plate which is opposed to the substrate, with the heating means disposed between the substrate and the cooling plate, the cooling plate having a heat reflecting function, wherein the heating means is opposed to a second surface of the two main surfaces of the substrate.

12. The method of manufacturing an image display apparatus according to claim 11, further comprising the step of assembling the container in a reduced pressure atmosphere by using the substrate that has been heated and cooled, after the heating step and the cooling step.

13. A method of manufacturing an image display apparatus having a container formed by using a substrate which has two main surfaces opposite to each other, the two main surfaces differing from each other in an in-plane distribution of emissivity, the method comprising the steps of:

heating the substrate placed in a reduced pressure atmosphere in a chamber by heating means opposed to the substrate; and cooling the substrate by a cooling plate which is opposed to the substrate, with the heating means disposed between the substrate and the cooling plate, the cooling plate having a heat reflecting function, wherein the heating means is opposed to one of the two main surfaces of the substrate which has a smaller distribution of emissivity.

14. The method of manufacturing an image display apparatus according to claim 13, further comprising the step of assembling the container in a reduced pressure atmosphere, by using the substrate that has been heated and cooled, after the heating step and the cooling step.

* * * * *